US005244039A

United States Patent [19]

Newton, Jr. et al.

[11] Patent Number: 5,244,039

[45] Date of Patent: Sep. 14, 1993

[54] ROTARY DRILL BITS

[75] Inventors: Thomas A. Newton, Jr., Harris County, Tex.; John M. Clegg, Bristol, England

[73] Assignee: Camco Drilling Group Ltd., Stonehouse, England

[21] Appl. No.: 786,035

[22] Filed: Oct. 31, 1991

[51] Int. Cl.[5] ..... E21B 10/46

[52] U.S. Cl. ..... 175/431

[58] Field of Search ..... 175/397, 431, 432, 379, 175/393, 401

[56] References Cited

U.S. PATENT DOCUMENTS 4,429,755 2/1984 Williamson ..... 175/431
4,475,606 10/1984 Crow ..... 175/431
4,545,441 10/1985 Williamson ..... 175/431
4,718,505 1/1988 Fuller .
4,823,892 4/1989 Fuller ..... 175/329
4,889,017 12/1989 Fuller et al. .
4,942,933 7/1990 Ban et al. ..... 175/431

*Primary Examiner*—Ramon S. Britts
*Assistant Examiner*—Frank S. Tsay

[57] ABSTRACT

A rotary drill bit for drilling holes in subsurface formations comprises a bit body having a shank for connection to a drill string, a plurality of preform primary cutting elements mounted on the bit body and defining a primary cutting profile having a downwardly convex nose portion. There are associated with at least certain of the primary cutting elements respective secondary elements which are spaced inwardly of the primary profile. The distance of the secondary elements from the primary profile, when measured in a direction perpendicular to said profile, is generally greater for secondary elements nearer the nose portion than it is for secondary elements further away from the nose portion, and is preferably such that the vertical distance of the secondary elements from the profile is substantially constant.

18 Claims, 2 Drawing Sheets

FIG 1
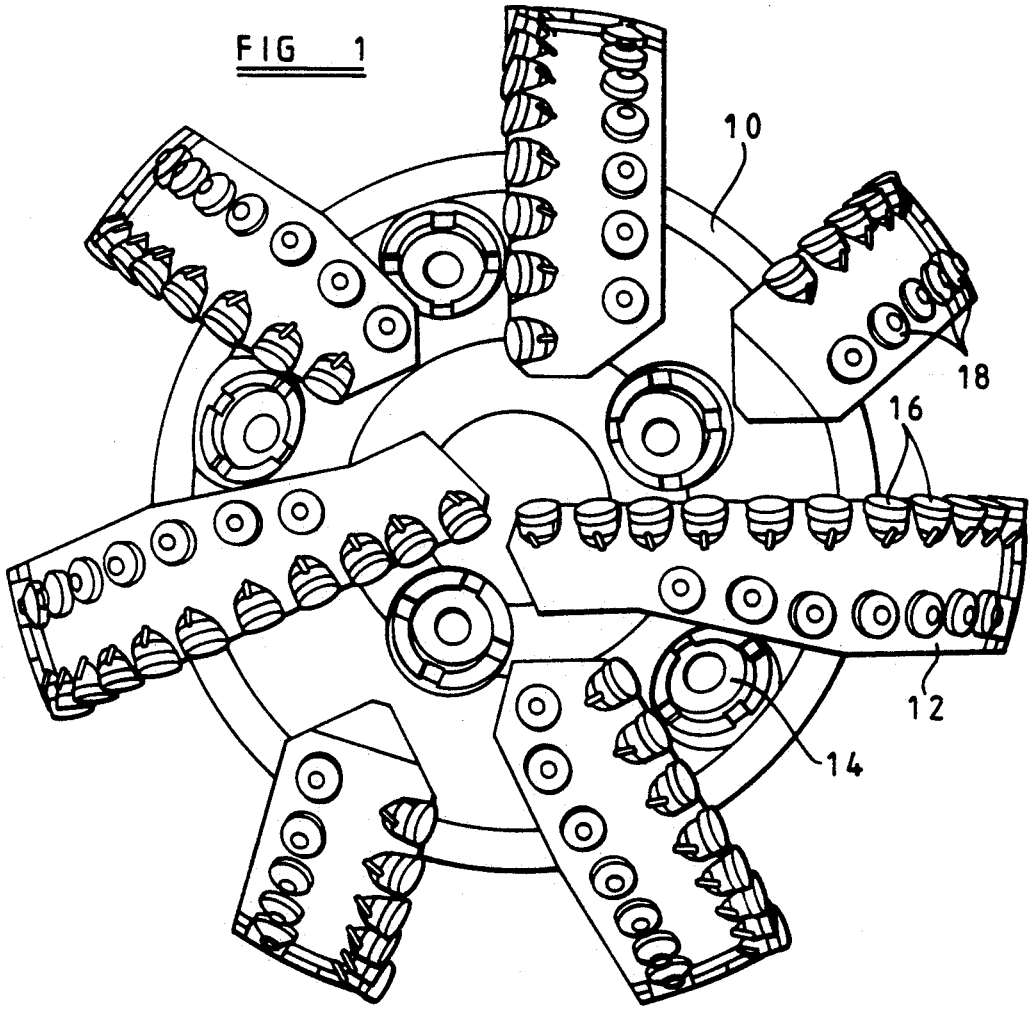
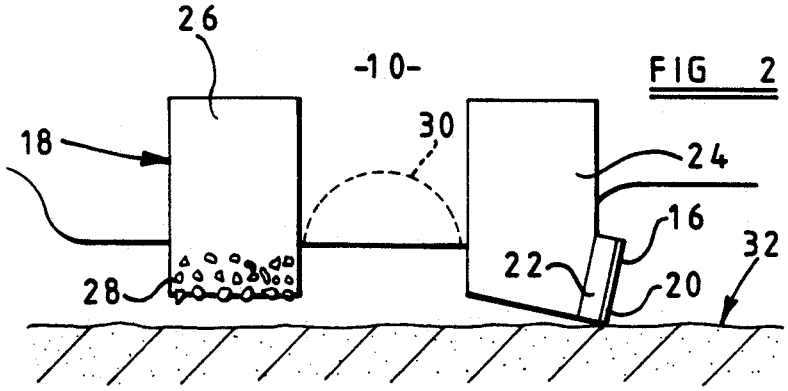

ROTARY DRILL BITS

BACKGROUND OF THE INVENTION

The invention relates to rotary drill bits for use in drilling or coring holes in subsurface formations, and of the kind comprising a bit body having a shank for connection to a drill string, a plurality of cutting elements mounted on the bit body, and a passage in the bit body for supplying drilling fluid to the surface of the bit body for cooling and/or cleaning the cutting elements, at least some of the cutting elements each comprising a preform cutting element having a superhard front cutting face.

The invention is particularly, but not exclusively, applicable to drill bits of the kind in which the cutting elements comprise preforms having a thin facing layer of polycrystalline diamond bonded to a backing layer of tungsten carbide. Such bits and cutting elements are well known and will not therefore be described in detail.

When drilling deep holes in subsurface formations, it often occurs that the drill bit passes through a comparatively soft formation and then strikes a significantly harder formation. Also there may be hard occlusions within a generally soft formation. When a bit using preform cutters meets such a hard formation the cutting elements may be subjected to very rapid wear or damage.

It has therefore been proposed to provide, on the rearward side of at least certain of the preform cutting elements, which may be regarded as primary cutting elements, secondary abrasion elements which are set slightly below (or inwardly of) the primary cutting profile defined by the primary cutting elements.

In this specification, the primary cutting profile is defined to mean a generally smooth notional surface which is swept out by the cutting edges of the primary cutting elements as the bit rotates without axial movement. The secondary profile is similarly defined as the notional surface swept out by the secondary elements.

With such an arrangement, during normal operation of the drill bit the major portion of the cutting or abrading action of the bit is performed by the preform primary cutting elements in the normal manner. However, should a primary cutting element wear rapidly or fracture, so as to be rendered ineffective, for example by striking a harder formation, the associated secondary abrasion element takes over the abrading action of the cutting element, thus permitting continued use of the drill bit. Provided the primary cutting element has not fractured or failed completely, it may resume some cutting or abrading action when the drill bit passes once more into softer formation.

The secondary elements may be formed in a variety of ways. For example, U.S. Pat. Nos. 4,718,505 and 4,889,017 describe a secondary abrasion element comprising a plurality of particles of superhard material, such as natural diamond, embedded in an elongate stud-like carrier element having one end wholly enclosed within a socket in the bit body which is spaced rearwardly from the respective primary cutting elements, and the other end protruding freely from the bit body transverse to the normal direction of rotation of the bit.

Hitherto, it has been the usual practice for all the secondary elements to be set slightly below, or inwardly of, the primary cutting profile by a substantially constant distance, measured perpendicular to the primary profile. However, it is believed that this may be disadvantageous, and may have the effect that secondary elements on some parts of the bit come into operation before secondary elements on other parts, even though they may be subjected to the same local conditions.

Because the drill bit is moving axially as drilling proceeds, the parameter which determines when a secondary element comes into operation, other things being equal, is its position, relative to the primary profile, measured in a direction parallel to the longitudinal axis of rotation of the drill bit (referred to herein, for convenience, as the "vertical" distance). However, the primary cutting profile of the drill bit is usually shaped to provide a "nose" portion which is generally convex, although not necessarily smoothly curved, when viewed in cross-section. The nose portion of the profile is that part thereof which is lowermost when drilling vertically. The nose portion may lie on the central longitudinal axis of the bit in the case where the primary profile is simply convex, or it may comprise an annular area spaced outwardly of said axis in the case where the central portion of the profile is concave, cone-shaped, or otherwise re-entrant.

Due to the generally convex shape of the nose portion, as viewed in cross-section, the vertical distance between each secondary element and the primary profile increases with distance from the nose portion of the profile if the secondary elements are spaced by a constant distance from the profile, measured perpendicularly from the profile.

This means that, when harder formation or occlusions are encountered when drilling, the backing-up or depth stop function is not shared equally between the secondary elements, but falls mainly on the secondary elements nearer the central axis of the bit, leading to excessive wear and/or failure of those elements.

The present invention therefore sets out to provide an improved form of drill bit in which this disadvantage may be alleviated or overcome.

SUMMARY OF THE INVENTION

According to the invention there is provided a rotary drill bit for use in drilling or coring holes in subsurface formations, comprising a bit body having a central longitudinal axis and a shank for connection to a drill string, a plurality of primary cutting elements mounted on the bit body and defining a primary cutting profile having a nose portion, a passage in the bit body for supplying drilling fluid to the surface of the bit body for cooling and/or cleaning the cutting elements, at least some of the primary cutting elements each comprising a preform cutting element having a superhard front cutting face, there being associated with at least certain of said primary cutting elements respective secondary elements spaced inwardly of said primary profile, the distance of said secondary elements from the primary profile, when measured in a direction perpendicular to said profile, being generally greater for secondary elements nearer the nose portion than it is for secondary elements further away from the nose portion.

It will be appreciated that, if the spacing between a secondary element and the profile defined by the primary cutters is increased, the time at which that secondary element comes into operation during use of the drill bit will be effectively delayed. By adjusting the distance by which each secondary element is spaced from the primary cutting profile in accordance with the invention, it is possible to ensure that secondary elements on different parts of the bit body come into operation at substantially the same time regardless of their location of the bit and even though their respective cutting elements may be subjected to different rates of wear.

The distance from the primary profile of secondary elements furthest from the nose portion may be substantially zero.

Preferably the secondary profile, defined by the secondary elements, is spaced inwardly of the primary profile by a distance, measured perpendicular to the primary profile, which decreases smoothly with distance from said nose portion of the drill bit.

Preferably also, the distance of at least the majority of said secondary elements from the primary profile is substantially constant, when measured in a direction parallel to the longitudinal axis of the drill bit. That is to say the distance between the profiles is substantially constant, when measured in a direction parallel to the longitudinal axis of the drill bit, over at least a major portion of the primary profile.

In one embodiment, each secondary element is spaced, rearwardly with respect to the normal direction of rotation of the bit, from a respective cutting element. Advantageously, each secondary element is located at substantially the same radial distance from the central longitudinal axis of the bit as the respective cutting element. It will be appreciated that, in this case, if the two profiles are uniformly vertically spaced then the vertical distance between each cutter and its associated abrasion element will also be uniform.

Conveniently, each preform primary cutting element comprises a thin facing layer of superhard material bonded to a less hard backing layer, and each cutting element may be mounted on a carrier received in a socket in the bit body.

Preferably each secondary element comprises a stud-like element protruding from the bit body. The stud-like element may be separately formed from the bit body and have one end received and retained within a socket in the bit body, the other end of the stud-like element protruding from the bit body. Alternatively the stud-like element may be integral with the bit body.

In either arrangement a single body of superhard material may be embedded in said projecting end of the stud-like secondary element. For example, the projecting end of the stud-like secondary element may be generally frusto-conical in shape, said single body of superhard material being embedded at the central extremity of said frusto-conical shape.

Alternatively a plurality of bodies of superhard material may be embedded in at least the projecting end of said stud-like element.

In another embodiment said stud-like secondary element may be formed from tungsten carbide.

The primary cutting elements and secondary elements may be located on the bit body in radially spaced groups, the distance between the primary profile and the secondary profile being substantially uniform within each group but decreasing from group to group as the distance of the group from the nose portion of the bit increases.

BRIEF DESCRIPTION OF THE DRAWINGS

FIG. 1 is a perspective view of the end face of a rotary drill bit including primary cutting elements and secondary abrasion elements;

FIG. 2 is a diagrammatic section through one primary cutting element and its associated secondary abrasion element;

DETAILED DESCRIPTION OF THE PREFERRED EMBODIMENTS

Figure 3:
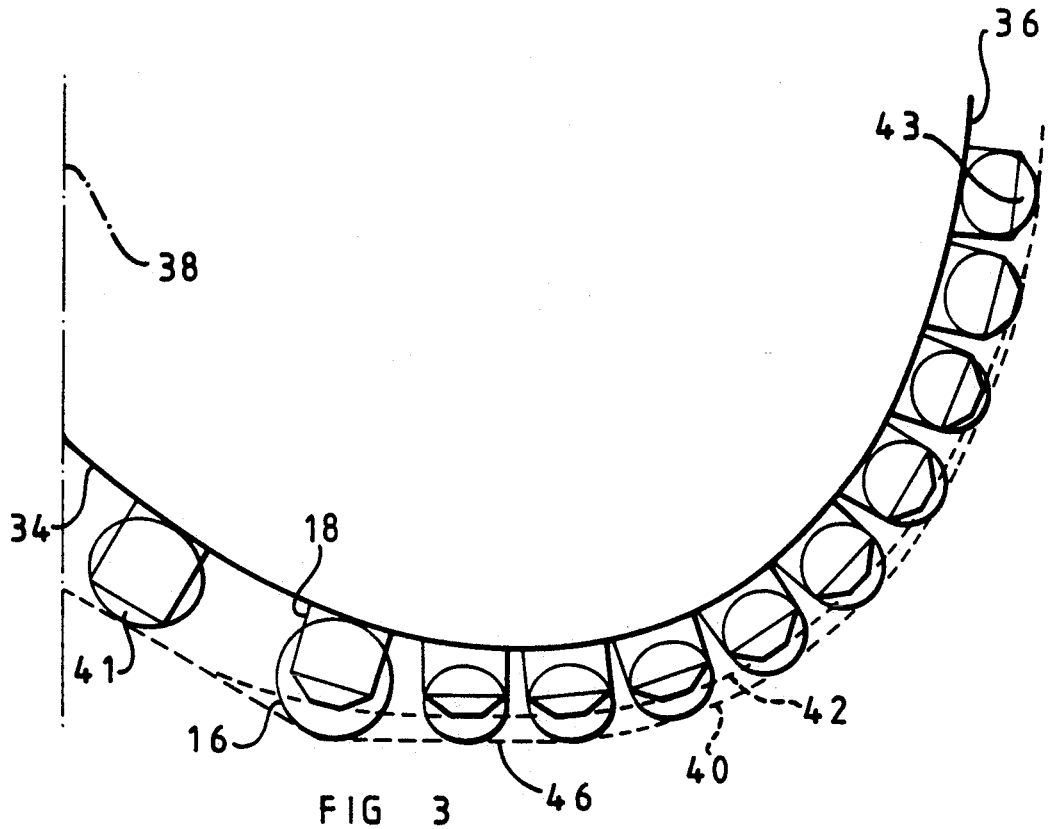
FIG. 3 is a diagrammatic half-section through a rotary drill bit according to the invention, showing both primary cutting elements and secondary abrasion elements.

Referring to FIG. 1: a rotary bit body has a leading end face 10 formed with a plurality of blades 12 upstanding from the surface of the bit body. Drilling fluid is supplied through a passage (not shown) within the bit body, and flows out through nozzles 14 located on the leading face 10 so as to cool and clean primary cutting elements 16 mounted side-by-side along each blade 12. Spaced rearwardly of the outermost cutting elements 16 on each blade are secondary abrasion elements 18. Although the drawing shows only two abrasion elements 18 mounted on each blade 12, any number of the primary cutting elements 16 may be provided with an associated abrasion element 18, and although each abrasion element 18 may lie at the same radial distance from the axis of rotation of the bit as its associated cutting element 16, this is not essential.

The secondary abrasion elements 18 shown in FIG. 1 each comprise a single body of superhard material, such as natural or synthetic diamond, mounted at the apex of a generally conical end face of a stud, for example of cemented tungsten carbide, received in a socket in the blade 12. However, other forms of secondary element may be employed. For example, the separate stud may be replaced by a projecting boss, formed integrally with the bit body and in the conical extremity of which the superhard element is embedded.

FIG. 2 shows in greater detail another suitable form of secondary abrasion element, which will be described below. Although the secondary elements specifically described are abrasion elements, the invention also includes arrangements where the secondary elements are cutting elements, for example are similar to the primary elements and comprise polycrystalline diamond preform cutting elements.

As previously mentioned, in an alternative embodiment the secondary elements may be in the form of tungsten carbide studs protruding from the bit body. The studs may be integral with the bit body, forming bosses on the surface thereof, or may comprise separately formed studs which are received and retained in sockets in the bit body.

Referring to FIG. 2, each primary cutting element 16 is a circular preform comprising a front thin hard facing layer 20 of polycrystalline diamond bonded to a thicker backing layer 22 of less hard material, such as tungsten carbide. The preform is bonded, in known manner, to an inclined surface on a generally cylindrical stud 24 which is received in a socket in the bit body 10. The stud 24 may be formed from cemented tungsten carbide. The bit body 10 may be machined from steel or may be moulded from matrix material by a powder metallurgy process, in known manner.

Each secondary abrasion element 18 also comprises a generally cylindrical stud 26 which is received in a socket in the bit body 10 spaced rearwardly of the stud 24. In this example the stud 26 is formed from cemented tungsten carbide impregnated with particles 28 of natural or synthetic diamond or other superhard material. The superhard material may be impregnated throughout the body of the stud 26, or may be embedded in only the outer surface portion thereof.

In the arrangement shown, the stud 26 of the abrasion element extends substantially at right angles to the surface of the formation 32, but operation in softer formations may be enhanced by inclining the axis of the stud 26 forwardly or by inclining the outer surface of the abrasion element away from the formation in the direction of rotation.

In order to improve the cooling of the cutting elements and abrasion elements, a channel for directing drilling fluid may be provided between the two rows of elements as indicated at 30 in FIG. 2.

Any known form of preform cutting element 16 having a superhard cutting face may be employed and the invention includes within its scope arrangements where the cutting element is mounted directly on the bit body, or on another form of support in the bit body, rather than on a cylindrical stud such as 24.

It will be seen that the primary cutting element 16 projects downwardly slightly further than the associated abrasion element 18, so that initially, before any significant wear of the cutting element has occurred, only the cutting element 16 engages the formation 32. The abrasion element 18 will only engage and abrade the formation 32 when the primary cutting element 16 has worn beyond a certain level, or has failed through fracture. The further the cutting element 16 projects downwardly below the abrasion element 18 the greater is the wear of the primary element which must occur before the abrasion element 18 begins to abrade the formation 32. It is therefore possible, by selectively varying the vertical distances between the primary cutting elements 16 and the abrasion elements 18, to ensure that each of the abrasion elements 18 comes into operation and begins to abrade the formation 32 at substantially the same point in time during operation of the drill bit, and FIGS. 3 and 4 show two particular arrangements of cutting elements and abrasion elements by which this result may be achieved, in accordance with the present invention.

FIG. 3 is a diagrammatic sectional representation of one half of a rotary drill bit having a generally cone-shaped central recess 34 and a gauge portion 36. The central longitudinal axis of rotation of the drill bit is shown by the dotted line 38. A row of primary cutting elements 16 and associated secondary abrasion elements 18 is shown extending from the central recess 34 to the gauge portion 36. Each abrasion element lies directly behind its respective cutting element, with respect to the normal direction of forward rotation of the drill bit.

Figure 4:
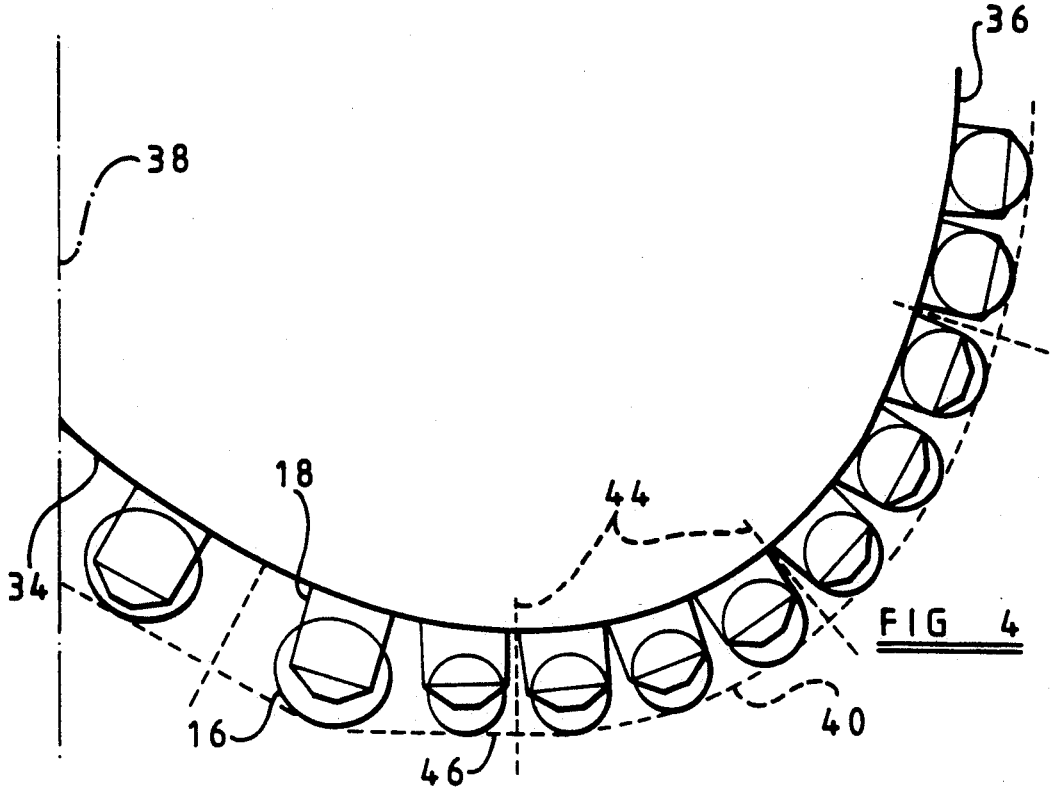
FIG. 4 is a similar view to FIG. 3 showing a further embodiment of the invention.

FIGS. 3 and 4 are intended to show, in a single quasi-sectional view, the relative radial positions of a series of primary and secondary elements on the drill bit. Although all the elements of a given type (i.e. primary or secondary) may be arranged side-by-side along a single blade, as shown, they could equally well be spaced apart circumferentially as well as radially, on the bit body. FIGS. 3 and 4 should therefore be regarded as representing the radial positions in which a series of circumferentially spaced elements pass through a fixed transverse plane, once during each revolution of the bit. Whereas the bit shown in FIG. 1 only has abrasion elements trailing the outermost cutting elements, the bit represented by FIG. 3 has abrasion elements spanning virtually the entire bit face.

In practice also, the bit body will normally carry further cutting elements, not shown in FIGS. 3 and 4, the radial positions of which further elements overlap the radial positions of the elements shown, so that a substantially continuous surface profile is cut in the formation as the drill bit rotates.

The profiles defined by the primary cutting elements and the secondary abrasion elements are represented by dotted lines 40 and 42 respectively.

Due to the presence of the central cone-shaped recess 34 in the bit body, each of the primary profile 40 is generally convex as seen in section, so as to provide an annular nose portion 46 which is lowermost when the drill bit is drilling vertically downwards.

It will be seen that, in the arrangement of FIG. 3, the spacing between the profiles of the cutting and abrasion elements 40, 42, (measured perpendicularly to the primary profile 40) decreases continuously as the profiles extend away from the annular nose portion 46. The rate of decrease is such as to maintain a substantially uniform vertical distance (i.e. measured in a direction parallel to the axis 38) between the two profiles in the region between the nose portion 46 and the outermost cutting elements 43.

The spacing between the profiles 40, 42 decreases to zero in the region of the gauge portion 36. In the arrangement shown, the decrease in the spacing between the profiles is more rapid radially inwards of the nose portion, and becomes substantially zero at the location of the innermost element 41. In other embodiments of the invention, however, a fixed vertical spacing between the two profiles may be maintained also in the central recessed region 34.

In the variant of FIG. 4 the cutting elements 16 and associated abrasion elements 18 are arranged in radially spaced groups, as denoted by dotted separation lines 44. The spacing between the abrasion elements 18 and the primary profile 40 of the cutting element (measured perpendicular to the profile) is uniform within each group, but the spacing for successive groups decreases as the distance of the group from the nose portion 46 increases.

We claim:

1. A rotary drill bit for use in drilling or coring holes in subsurface formations, comprising a bit body having a central longitudinal axis and a shank for connection to a drill string, a plurality of primary cutting elements mounted on the bit body and defining a primary cutting profile having an angle of inclination with respect to the central longitudinal axis of the bit body, and having a nose portion, said angle of inclination decreasing in a direction away from said nose portion, a passage in the bit body for cooling and cleaning the cutting elements, at least some of the primary cutting elements each comprising a preform cutting element having a superhard front cutting face, there being associated with and following with respect to the cutting direction at least certain of said primary cutting elements respective secondary elements spaced inwardly, with respect to said central axis, of said primary profile, the distance of said secondary elements from primary profile, when measured in a direction perpendicular to said profile, being greater for secondary elements nearer the nose portion than it is for secondary elements further away from the nose portion.

2. A rotary drill bit according to claim 1, wherein the distance from the primary profile of secondary elements furthest from the nose portion is substantially zero.

3. A rotary drill bit according to claim 1, wherein a secondary profile, defined by the secondary elements, is spaced inwardly of the primary profile by a distance, measured perpendicular to the primary profile, which decreases smoothly with distance from said nose portion of the drill bit.

4. A rotary drill bit according to claim 1, wherein the distance of a secondary profile, defined by the secondary elements, from the primary profile is substantially constant, when measured in a direction parallel to the longitudinal axis of the drill bit, over at least a major portion of the primary profile.

5. A rotary drill Bit according to claim 1, wherein each secondary element is spaced, rearwardly with respect to the normal direction of rotation of the bit, from a respective cutting element.

6. A rotary drill bit according to claim 5, wherein each secondary element is located at substantially the same radial distance from the central longitudinal axis of the bit as the respective cutting element.

7. A rotary element according to claim 1, wherein each preform primary cutting element comprises a thin facing layer of superhard material bonded to a less hard backing layer.

8. A rotary drill bit according to claim 1, wherein each cutting element is mounted on a carrier received in a socket in the bit body.

9. A rotary drill bit according to claim 1, wherein each secondary element comprises a stud-like element protruding from the bit body.

10. A rotary drill bit according to claim 9, wherein the stud-like element is separately formed from the bit body and has one end received and retained within a socket in the bit body, the other end the stud-like element protruding from the bit body.

11. A rotary drill bit according to claim 9, wherein the stud-like element is integral with the bit body.

12. A rotary drill bit according to claim 6, wherein a single body of superhard material is embedded in said projecting end of the stud-like secondary element.

13. A rotary drill according to claim 12, wherein the projecting end of the stud-like secondary element is generally frusto-conical in shape, and said single body of superhard material is embedded at the central extremity of said frusto-conical shape.

14. A rotary drill bit according to claim 10, wherein a plurality of bodies of superhard material are embedded in at least the projecting end of said stud-like element.

15. A rotary drill bit according to claim 10, wherein said stud-like secondary element is formed from tungsten carbide.

16. A rotary drill bit according to claim 1, wherein the primary cutting elements and secondary elements are located on the bit body in radially spaced groups, the distance between the primary profile and secondary profile defined by the secondary elements, measured perpendicular to the primary profile, being substantially uniform within each group but decreasing from group to group as the distance of the group from the nose portion of the bit increases.

17. A rotary drill bit for use in drilling or coring holes in subsurface formations, comprising a bit body having a central longitudinal axis and a shank for connection to a drill string, a plurality of primary cutting elements mounted on the bit body ad defining a primary cutting profile having an angle of inclination with respect to the central longitudinal axis of the bit body, and having a nose portion, said angle of inclination decreasing in a direction away from said nose portion, a passage in the bit body for supplying drilling fluid to the surface of the bit body for cooling and cleaning the cutting elements, at least some of the primary cutting elements each comprising a preform cutting element having a superhard front cutting face, there being associated with and following with respect to the cutting direction at least certain of said primary cutting elements respective secondary elements spaced inwardly, with respect to said central axis of said primary profile, the distance of said secondary elements from the primary profile, when measured in a direction perpendicular to said profile, varying in accordance with said angle of inclination, said distance decreasing as said angle of inclination approaches zero.

18. A rotary drill bit according to claim 13, wherein the distance of a secondary profile, defined by said secondary elements, from the primary profile is substantially constant, when measured in a direction parallel to the longitudinal axis of the drill bit .

* * * * *